US006109473A

United States Patent [19]

Neveu et al.

[11] Patent Number: 6,109,473

[45] Date of Patent: Aug. 29, 2000

[54] SYSTEM FOR DISPENSING SHEETS INDIVIDUALLY

[75] Inventors: Jean-Louis Neveu, Colmar; Bernard Louis Dit Picard, Amfreville la Campagne, both of France

[73] Assignee: Fort James France, Kunheim, France

[21] Appl. No.: 09/194,186

[22] PCT Filed: Mar. 27, 1998

[86] PCT No.: PCT/FR98/00641

§ 371 Date: Nov. 24, 1998

§ 102(e) Date: Nov. 24, 1998

[87] PCT Pub. No.: WO98/43524

PCT Pub. Date: Oct. 8, 1998

[30] Foreign Application Priority Data

Mar. 28, 1997 [FR] France ..... 97 03873

[51] Int. Cl.[7] ..... B65H 1/00

[52] U.S. Cl. ..... 221/63; 221/45

[58] Field of Search ..... 221/45, 44, 46, 221/48, 63

[56] References Cited

U.S. PATENT DOCUMENTS

| | | | |
|---|---|---|---|
| 4,905,868 | 3/1990 | Beane et al. | 221/44 |
| 5,137,173 | 8/1992 | Hughes et al. | 221/48 X |
| 5,205,455 | 4/1993 | Moody | 221/63 X |
| 5,211,308 | 5/1993 | Decker et al. | 221/63 |
| 5,215,211 | 6/1993 | Eberle | 221/46 X |
| 5,246,137 | 9/1993 | Schutz et al. | 221/44 |
| 5,310,083 | 5/1994 | Rizzuto | 221/63 |
| 5,332,118 | 7/1994 | Muckenfuhs | 221/48 |
| 5,577,634 | 11/1996 | Morand | 221/63 X |
| 5,749,492 | 5/1998 | Petterson | 221/44 X |
| 5,765,718 | 6/1998 | Grasso et al. | 221/63 X |
| 5,857,642 | 1/1999 | Zinnbauer | 221/63 X |

FOREIGN PATENT DOCUMENTS

| | | | |
|---|---|---|---|
| 2145693 | 4/1985 | United Kingdom | 221/46 |

*Primary Examiner*—Christopher P. Ellis
*Assistant Examiner*—Gene O. Crawford
*Attorney, Agent, or Firm*—Breiner & Breiner

[57] ABSTRACT

A dispenser for sheets of fibrous material, such as a non-woven or cellulose wadding of a specific surface weight between 15 and 90 g/m$^2$ per ply, a strip of the fibrous material wound into a roll and pre-perforated so as to provide a sequence of sheets linked to one another by rows of perforation bridges. The dispenser is fitted with a feed cone. The material is dispensed by the cone through a smaller diameter apex. The proportion of perforation bridges is selected to be no more than 30% above that constituting the machining limit of the fibrous material and in that the diameter of the apex of the cone is between a minimum value corresponding to a force of removal just exceeding the force of rupture of the material and a maximum value corresponding to an effectiveness equal to or larger than 90%, in particular equal to or larger than 95%.

8 Claims, 1 Drawing Sheet

SYSTEM FOR DISPENSING SHEETS INDIVIDUALLY

FIELD OF THE INVENTION

The invention relates to a dispenser dispensing one by one fibrous sheets, for example of paper or non-woven towels, napkins, rags, which are unwound from a roll at the dispenser's center and are fed across illustratively, a conical orifice.

BACKGROUND OF THE INVENTION

Paper towels, napkins or rags are known in the form of a continuous strip wound as a roll. Regularly spaced transverse perforation lines along this strip connect sheets which can be sequentially torn off. Each sheet therefore can be used individually. For high volume use, comparatively large rolls are housed inside cases. These cases are fitted with an element implementing cutting and feeding of a roll.

The present invention concerns centrally unwinding dispensers.

In such a system, a roll is operated without a spindle and the particular strip is pulled from its center through a feed element of small cross-section. Illustratively, this feed element assumes the shape of a hollow frustrum of a cone of which the minimum diameter extends outward. The strip enters the frustrum of a cone at its maximum diameter and is pulled out through the opposite orifice with the least diameter. This latter orifice causes some drag on the tension exerted by the user. The cross-section of the latter orifice is selected in such a manner that when the user pulls on the sheet, rupture occurs at the perforation line between a sheet already outside the cone and the next one still affixed inside. In this manner, one sheet is released after another. The force required to pull the strip through the cone is larger than the force needed to tear the sheets apart. Two consecutive sheets are reliably separated the moment the preceding one is wholly outside the cone.

Essentially the tear force required for the perforation lines is determined by two factors: the tear strength of the material to be dispensed and the percentage of bridge material left between the perforations of a line.

The removal force depends on several parameters:

- surface condition, specific surface weight and thickness of the dispensed material,
- roll width, number of sheet plies; in particular the amount of material passing through the cone is directly proportional to the roll width,
- the cone material and its surface condition, and
- the diameter of the orifice at the exit of the cone.

With respect to the last parameter, U.S. Pat. No. 4,905,868 relates to a cone of a centrally feeding paper dispenser. Therein, the cone's exit orifice includes at least one detachable portion. In this manner, the exit orifice can be matched in particular to the paper thickness of two or three plies.

In U.S. Pat. No. 5,246,137, the size of the exit orifice is adjusted using appropriate inserts.

The frustoconical element undergoes substantial wear because of the abrasive nature of cellulose wadding. As the cross-section of an exit orifice increases, the friction opposing the sheet motion drops rapidly. A time comes when the user meets with less drag when pulling on the sheet. Then the sheet no longer will automatically rupture along the perforated line.

The dispenser's effectiveness is then much degraded. An insert such as cited in the above document might then be used to repair the cone. Another solution is offered in U.S. Pat. No. 5,310,083 wherein wear of the conical element is slowed by extending it with a cylindrical element. The sheet contacting surface in the area of high friction thereby being increased, wall wear is reduced.

OBJECTS AND BRIEF DESCRIPTION OF THE INVENTION

One object of the present invention is to offer a novel dispenser of individual fibrous sheets in the form of a continuous strip of material wound as a roll, the sheets being connected by transverse perforated lines, the dispenser further being fitted with a feed cone having an exit orifice of diameter S through which the sheets are removed one by one.

Another object of the present invention involves a dispenser of which the effectiveness, that is the success rate in withdrawing sheets one by one, is improved and higher than or equal to 90%, in particular higher than 95%.

Another object of the present invention is to insure optimization of the dispenser over a longer service life in spite of the wear of the cone wall by friction with the fibrous material.

Another object of the invention involves a dispenser allowing the use of diverse materials for the cone, the precise cone diameter then being of lesser significance.

Another object of the invention involves a dispenser appropriate for any non-woven or cellulose wadding product and in the form of a centrally unwinding roll.

The dispenser of the invention is characterized in that the proportion of the perforated line's bridges is selected to be at most 30% higher than that constituting the machining limit of the fibrous material and in that the diameter of the cone's exit orifice S is between a minimum value corresponding to a force of removal just higher than the rupturing force of the material and a maximum value corresponding to an effectiveness E higher than or equal to 90%, in particular higher than or equal to 95%.

Preferably this bridge proportion is selected at a magnitude of at most 20% higher than that constituting the machining limit.

In particular, the invention relates to dispensing cellulose wadding material having two or more plies and of a specific surface weight between 15 and 45 g/m$^2$ per ply, in particular between 18 and 25 g/m$^2$. For such products, the proportion of perforated line bridges appropriately is between 12 and 30% and preferably between 12 and 18%. These magnitudes match the feeding requirements through a dispenser in which the diameter is between 8 and 11 mm, preferably between 8.5 and 10 mm.

In the present application, various expressions are defined as follows:

Fibrous materials: in particular creped or uncreped cellulose wadding (cotton) made from unprocessed paper or deinked paper pulp and is of one or two plies, of which the specific surface weight of a ply may vary between 15 and 45 g/m$^2$. This term also includes non-woven, for example "air-laid" products, consisting substantially of paper fibers made by a dry or wet process and bonded by any known means, for example by a hot crosslinking latex or another bonding agent such as a hot melt glue. The specific surface weight of these non-woven products can vary between 30 and 90 g/m$^2$.

Perforated lines: A perforated line is a sequence of perforations in a row, here transverse to the direction of sheet advance, with bridges present between the perforations. The bridge proportion is the ratio of the sum of bridge widths of a perforated line to the sheet width.

Machining limit: This is the bridge proportion below which the strip ruptures during manufacture in the stage preceding winding into a roll. The perforated line is made during roll processing before it is wound. The tensile stresses on the sheet at this time may rupture it at its weakest spot. This is precisely the area of the perforated line. Accordingly, the bridge proportion must be adequate for the particular material to preclude the sheet from rupturing during winding.

The Cone is a feed element known per se in the present state of the art.

In general, the cone assumes the shape of a hollow frustrum of a cone. It guides the sheet being removed and clamps the sheet when it passes through the lesser diameter exit orifice.

The cone can be extended by a cylindrical portion or a portion of any equivalent shape if equivalently functional. The cone can be made of metal or a plastic such as ABS, polypropylene or any other equivalent material.

The Removal Force is the tension which must be applied to the sheet to slip it through the cone.

The Effectiveness is expressed as a percentage and equals the number of times when, upon pulling on the free end of a sheet exiting the cone, the sheet separates from the next sheet in an appropriate manner at the perforated line and immediately downstream of the cone. Illustratively, an effectiveness of 90% means that for 100 tries at removing a sheet from the cone, 90 sheets were appropriately separated one by one. The remaining 10 sheets may reflect rupture outside the perforated line or also pulling down several sheets before rupture occurs.

The invention is elucidated in the following description of an embodiment and in relation to the drawing and functional plot.

DETAILED DESCRIPTION OF PRESENTLY PREFERRED EMBODIMENTS

Figure 1:
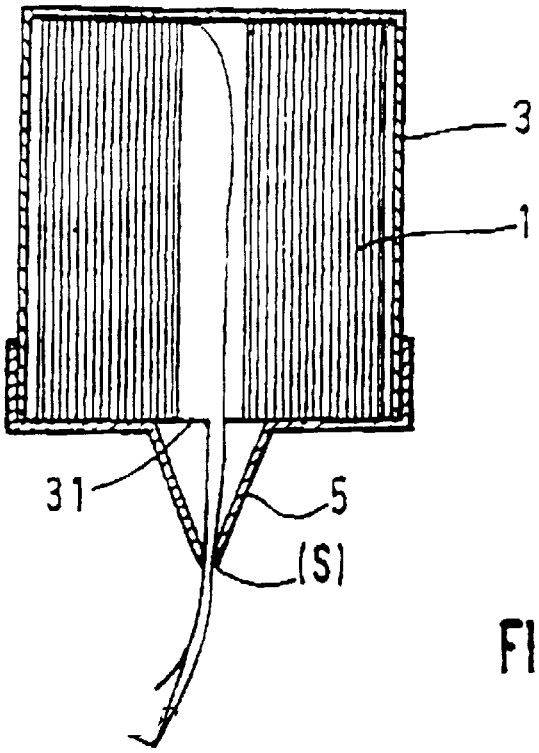
FIG. 1 is a cross-section of a case containing a roll of fibrous material fitted with a feed cone.

FIG. 1 shows a conventional dispenser with central unwinding and a feed cone. The roll 1 is made of cellulose wadding or another fibrous material and is held inside a case 3 fitted with a central orifice 31 in its base plate. A hollow cone 5 with openings at its two ends is mounted on the case base and communicates with the orifice 31. The cone's small diameter apex S constitutes the fibrous material feed orifice. The roll is without a spindle and is unwound from its center. This known dispenser operates as follows: the inside end of the continuous strip constituting roll 1 is freed and made to slip inside the cone so that it exits the small diameter orifice. The strip is transversely perforated at regular intervals and the perforated lines connect sheets which can be separated individually. Therefore, when pulling on the free end of the strip, the strip will rupture along a perforated line once the line has passed through the cone's small diameter orifice. If the dispenser dimensions have been properly selected, the tension applied to the strip to make it slip outside the cone exceeds the rupture strength of the perforated line. When this line has been moved outside the cone, it lacks adequate strength and will rupture.

It is understood that adequate dispenser operation entails a tradeoff. If the rupture strength of the perforated line is too high, rupture will not occur and several strip selects will be withdrawn without separating the sheets from one another. This will also be the case if the orifice S is too wide. Therefore, this element must frequently be exchanged when non-wovens or cellulose wadding are used since they are highly abrasive.

The selection of the initial orifice dimension is determined by the features of the fibrous material, in particular its thickness, the roll width and its strength. The orifice must not be excessively small, which would entail excessive tension being applied to the sheet. It would also be inconvenient for the user if premature rupture of the sheet ensued. On the other hand, as already discussed above in relation to wear, the orifice size should not be excessively wide.

It has been surprisingly discovered that the cone's service life can be extended by selecting a predetermined rupture strength for a perforation line. Experiment has shown that by selecting as low as possible a rupture strength while taking into account strip machining behavior, the tension required to remove a sheet can be commensurately decreased. Accordingly, the range of diameters is widened. Further, the service life of the feed cone is longer, depending on the cone's wear rate.

Removal experiments run on a conventional dispenser but with different cones and different two ply cellulose wadding products were carried out.

These products were as shown below.

| PRODUCT | A | B | C | D | E |
|---|---|---|---|---|---|
| Specific surface weight (g/m$^2$) | 2 × 20 | 2 × 20 | 2 × 21 | 2 × 23 | 2 × 22.5 |
| Width (mm) | 210 | 210 | 245 | 200 | 200 |
| Thickness (1/100 mm) | 110 | 115 | 110 | 96 | 155 |
| Rupture strength of perforated line (cN) | 370 | 400 | 720 | 1100 | 680 |
| % Bridges | 14 | 20 | 40 | 42 | 25 |

Products B, C, D, E are commercial. Product A is a product of the invention.

The effectiveness of each product was determined by counting the number of times the sheets separated properly following their removal and was plotted in ortho-normalized manner for the effectiveness and the diameter.

Figure 2:
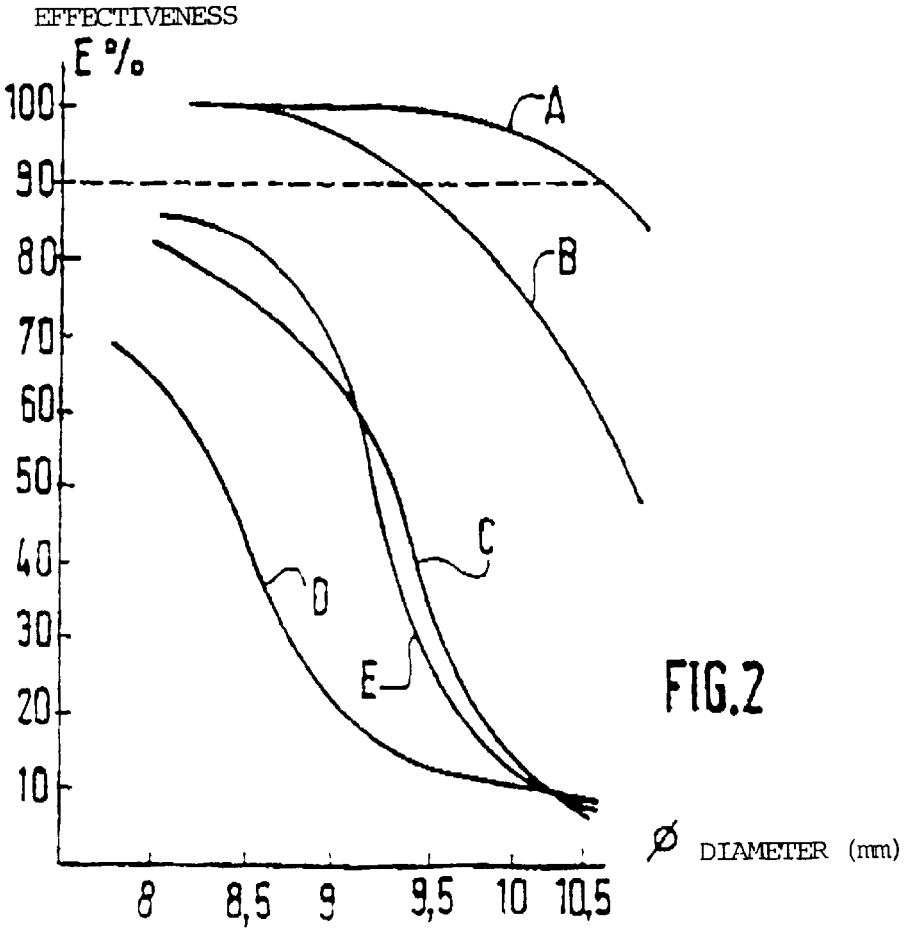
FIG. 2 is a plot of curves of the dispenser effectiveness as a function of cone diameter and for several values of bridge proportions.

FIG. 2 shows that for the product A, with the bridge proportions being 14%, that is at a value very close to the limit of product machining, the curve offers a fairly wide plateau for cone diameters between 8 to 10.5 mm.

This plateau is quite narrow for the other products. Therefore, the cones must be exchanged more frequently for those products than for product A.

A second set of tests was run with cones of a specified diameter, in this instance 9.5 mm, and the removal force, the rupture strength of the perforated line and the feeding effectiveness were determined for three products, namely;

F: conventional cellulose wadding paper sold by applicant as Lotus Professional, with two plies, each of 20 g/m$^2$; the bridge proportion is 35%;

G: cellulose wadding of the invention, with two plies each of 20 g/m$^2$ and a bridge proportion of 16% and;

H: wadding of the invention and of another quality, with two plies each of 20 g/m$^2$ and also a bridge proportion of 16%.

Measurement Technique

A dispenser was suspended from the test cell of a dynamometer. Following installation of the dispenser and placing a roll in it, the first sheet was dispensed. Thereupon, the test cell was "nulled".

Next, manual tension was applied to the strip to remove a sheet and the maximum force to effect removal was recorded by the dynamometer. In this manner, several test sequences were carried out. The same equipment was used to determine the tear strength. After moving the perforated line between two sheets out of the cone, the strip was locked inside the cone to preclude it from being advanced out of it. The lower sheet was connected to the lower dynamometer clamp which was then displaced. Testing was carried out at a low speed of 100 mm/min.

Several test runs were carried out in this manner. The mean values and the standard deviations of the test values were then calculated. The effectiveness (rate) E was determined merely be counting.

The test results are shown in the Table below.

| | F | G | H |
|---|---|---|---|
| Force of Removal Mean (N) | 11.59 | 10.96 | 7.91 |
| Standard Deviation | 1.95 | 1.35 | 1.11 |
| Force of Rupture Mean (N) | 14.29 | 8.14 | 7.03 |
| Standard Deviation | 3.38 | 1.99 | 1.80 |
| Effectiveness Rate E | 15% | 93% | 97% |

It shows that relative to the product F, the rupture strength of product G offers excellent effective rates, with the wadding having substantially the same strength properties. The rate E is also good for H. Moreover, the rupture force is 10 to 20% less relative to the removal force. This applies as long as the tissue paper manufacturing is stabilized and as long as the resulting tissue paper retains substantially narrowly defined specific surface weights, thicknesses and rupture strengths.

It was shown that a sufficient bridge proportion is required to assure industrial production. This bridge proportion is at least 12% for the tissue papers commonly available in commerce and made of creped cellulose wadding of which the specific surface weight is between 18 and 35 g/m$^2$ per ply.

It is known that in practice substantial manufacturing variations may arise. It was found in this respect that, to achieve a minimum effectiveness of 95% in dispensing sheets one by one, a sufficient difference is required between the force needed to remove a sheet through the feed orifice and the rupture strength of the perforated segment of the sheet. It suffices that the force of removal be at least 50% larger than the strength of the perforated portion. Preferably, this force is be 100% larger than the former one. Such a difference allows absorbing the variations in properties of the tissue paper from their nominal values, that is of specific surface weight, thickness, strength and also dimensional variations of the feed orifice such as wear-caused enlargement due to tissue paper abrasion during removal. Tests were run on different lots of two ply tissue paper of which the specific surface weight was 20 g/m$^2$ per ply. The perforation rates entailed bridge proportions of 12.5, 14.3, 16 and 35%.

| Lots | % Bridges | Rupture strength of perforated line in cN | Removal force in cN, cone diameter = 9.5 mm | Gap in % | Effectiveness in % | Removal force in cN, cone diameter = 8.5 mm | Effectiveness in % |
|---|---|---|---|---|---|---|---|
| 280 | 12.5 | 380 | 1215 | 220 | 100 | 2100 | 100 |
| 283 | 12.5 | 510 | 1216 | 140 | 100 | | |
| 224 | 14.3 | 480 | 860 | 80 | 100 | | |
| 219 | 14.3 | 480 | 980 | 104 | 100 | | |
| 223 | 14.3 | 450 | 950 | 111 | 100 | | |
| 197 | 16 | 955 | 980 | 0.0 | 86.7 | | |
| 83 | 16 | 870 | 1050 | 20 | 86.7 | | |
| 7840 | 35 | 1340 | 970 | — | 38 | 1800 | 77 |

The table shows that while the force of removal is of course higher for a smaller cone, satisfactory effectiveness nevertheless is not assured, and that further the difference between the removal forces and the strength of the perforated line must be substantial. We observed in practice that when the removal force is twice the rupture force, dispensing effectiveness near 100% is possible and will exceed 99%.

In another (not shown) feature of the invention, the strip sheets preferably are detached when passing through the feed cone by initiating rupture at the edges of the sheet near the perforated line. Illustratively, each side of the roll width is notched. This notch preferably is 10 mm long.

What is claimed is:

1. A dispenser for sheets of fibrous material, said fibrous material having a specific surface weight between 15 and 90 g/m$^2$ per ply and is present as a continuous strip of sheets wound as a roll and perforated in such a manner so as to define a sequence of sheets connected to each other by a series of perforation bridges, said dispenser comprising a case and a feed cone, the fibrous material being dispensed through a smaller diameter apex of the cone, wherein a proportion of bridges in a perforation line is selected to be no more than 30% above a bridge proportion determining a machining limit of said fibrous material, wherein the smaller diameter of the apex is between a minimum value corresponding to a force of removal exceeding force of rupture of said fibrous material and a maximum value corresponding to an effectiveness larger than or equal to 90%, and wherein the force of removal exceeds by at least 50% strength of the perforation line.

2. Dispenser as claimed in claim 1 wherein the fibrous material is a non-woven having a specific surface weight between 30 and 90 g/m$^2$.

3. Dispenser as claimed in claim 1 wherein each perforation line separating two consecutive sheets comprises at least one rupture initiating feature.

4. Dispenser as claimed in claim 3 wherein the rupture initiating feature is present at a side edge of the sheet.

5. Dispenser as claimed in claim 1 wherein the fibrous material is a two ply cellulose wadding.

6. Dispenser as claimed in claim 5 wherein the specific surface weight of each ply is between 15 and 45 g/m$^2$.

7. Dispenser as claimed in either of claim 5 or 6 wherein the proportion of bridges is between 12 and 30%.

8. Dispenser as claimed in either of claim 5 or 6 wherein the smaller diameter of the cone is between 8 and 11 mm.

* * * * *